US006698117B2

(12) United States Patent
Stefany

(10) Patent No.: US 6,698,117 B2
(45) Date of Patent: Mar. 2, 2004

(54) GREETING CARD SYSTEM INCLUDING ORNAMENT

(76) Inventor: Sarah Stefany, 16356 N. Thompson Peak Pkwy., Suite 2010 North, Scottsdale, AZ (US) 85250

( * ) Notice: Subject to any disclaimer, the term of this patent is extended or adjusted under 35 U.S.C. 154(b) by 0 days.

(21) Appl. No.: 10/084,285

(22) Filed: Feb. 26, 2002

(65) Prior Publication Data

US 2002/0178626 A1 Dec. 5, 2002

Related U.S. Application Data

(60) Provisional application No. 60/271,862, filed on Feb. 27, 2001.

(51) Int. Cl.[7] ..... G09F 1/00

(52) U.S. Cl. ..... 40/124.11; D9/457; 206/348; 206/495

(58) Field of Search ..... 40/124.11; D9/457; 206/348, 486, 495, 496

(56) References Cited

U.S. PATENT DOCUMENTS 1,639,672 A * 8/1927 Schraysshuen ..... 206/348
D400,104 S * 10/1998 Ash et al. ..... D9/457
6,134,821 A * 10/2000 Love ..... 40/600

OTHER PUBLICATIONS

Sand Script's Bell, Bell Favor #1, http://web.archive.org/web/20021030061934/http://www.sandscripts.com/catalog/wedding/gif/imp..r (Accessed Oct. 29, 2002) Date of web page Aug. 22, 2000.*

* cited by examiner

*Primary Examiner*—Cassandra H. Davis
(74) *Attorney, Agent, or Firm*—Gottlieb, Rackman & Reisman, P.C.

(57) ABSTRACT

A greeting card including an ornament/charm, and a jewelry fashion accessory either packaged together or purchased separately from a single merchandising fixture is provided. This novel card system allows the sender to provide a convenient object for the recipient to display on a fashion accessory, thus providing for the long term remembrance of the sender and also stimulate sales of greeting cards so that ornaments/charms can be collected to adhere to the fashion accessory received with the first card. The card provides all the functions of a conventional greeting card, such as delivering an appropriate message form the sender to the recipient. However upon receipt of the card, the ornament/charm may be fashionably displayed, and the card therefore provides an impression which endures much longer than if the card were simply stored away.

31 Claims, 2 Drawing Sheets

FIG. 2
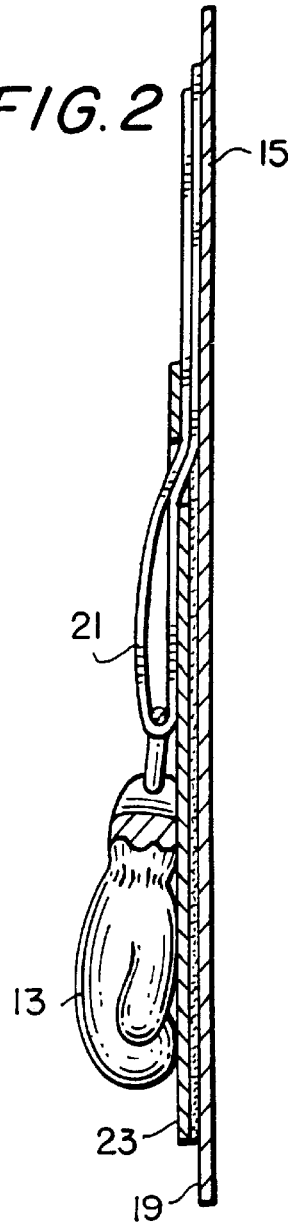
FIG. 4
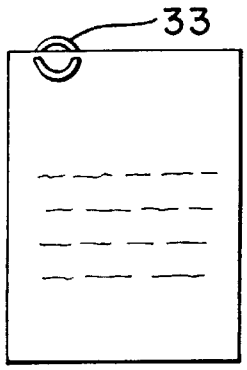
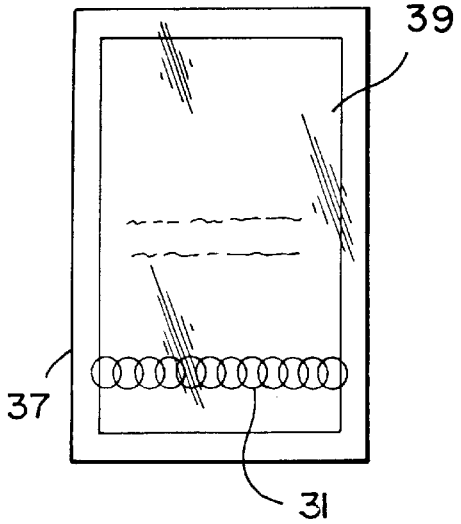
FIG. 5
FIG. 3
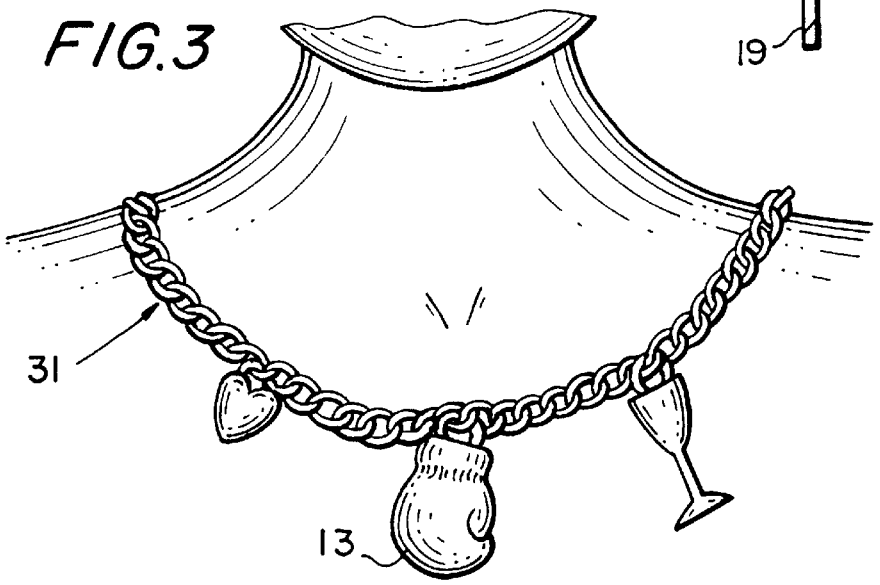

GREETING CARD SYSTEM INCLUDING ORNAMENT

This application claims the benefit of provisional application No. 60/271,862 filed Feb. 27, 2001.

BACKGROUND OF THE INVENTION

The present invention relates to a greeting card system including a pewter, brass, sterling silver or gold charm/ornament for the use of attaching to a secondary jewelry component. The ornament is designed to be advantageously suspended on a piece of jewelry or personal accessory for use of fashionable decoration for people and pets. The combination greeting card, charm/ornament and jewelry accessory functions as a system for giving and receiving a memento or other physical object in order to convey and especially preserve a memory.

There are a variety of designs for greeting cards on today's market. In addition to having the greeting card convey an appropriate greeting, today's cards attempt to capture attention by means of their particular design or other entertaining quality. One of the more increasingly common uses of a greeting card is in conjunction with the transmittal of a package, gift, or similar item. Combining a greeting card and a commemorative gift provides for an enhanced commercial product in that a consumer wishing to purchase a gift may also provide a greeting card simultaneously. Likewise, a purchaser intending to send a greeting card may also provide a small collectible or gift. Hence, the combined greeting card and gift, or "greeting gift," is an ideal product for satisfying two purposes.

Various greeting gifts have been suggested for transmitting a gift and conveying a greeting. Suggestions have been made for attracting attention or providing a package and message that appeal to purchasers and their intended gift recipients.

Prior patents disclosing greeting cards which include ornaments include: U.S. Pat. No. 2,616,199 issued to Seymour Robins on Nov. 4, 1952; U.S. Pat. No. 3,411,228 issued to John W. Lacey on Nov. 19, 1968; U.S. Pat. No. 4,055,690 issued to Michael P. Patterson on Oct. 25, 1977; U.S. Pat. No. 5,670,219 issued to Hong C. Na on Sep. 23, 1997; and U.S. Pat. No. 4,084,015, issued to Michael P. Patterson on Apr. 11, 1978.

SUMMARY OF THE INVENTION

The present invention provides a greeting card including an ornament/charm packaged with a ring as a bridging mechanism, and a jewelry fashion accessory; either packaged together or purchased separately as part of a merchandising system. This novel card system allows the sender to provide a convenient ornamental object for the recipient to display on a fashion accessory, thus providing for the long term remembrance of the sender, and also to stimulate sales of greeting cards so that ornaments/charms can be collected to adhere to the fashion accessory received with the first card. The card provides all the functions of a conventional greeting card, such as delivering an appropriate message from the sender to the recipient. Such greeting categories include: Birthday, Get Well, Good Bye, Congratulations, Retirement, Friendship, Holiday Greetings, Good Luck, and various other special occasions. However upon receipt of the card, the ornament/charm, which reflects the message of the card, may be fashionably displayed, and the card therefore provides an impression which endures much longer than if the card were simply stored away.

Accordingly, in this invention, we have a greeting card system, which has a message that relates to what a consumer is trying to convey by sending the card-acknowledging a date, memorializing an event or communicating a message. The card conveys a message about something specific or a specific event/occasion.

Also, in the inventive system, an ornament such as a charm is attached to the greeting card. The charm is related to the card's message in a creative way. (Example: Christmas card with a candy cane charm states "happy holidays", a Get Well card with a can of chicken soup charm states "feel better", a Wedding card with a wedding cake charm states "wishing you a lifetime of love", etc.)

The card functions as a delivery mechanism and thus the primary goal of the inventive system is to deliver to the card recipient a memento (reminder, memorialization, keepsake related to the card's message—the charm), which will, by the nature of it's use (displayed on an accessory), keep alive the sentiment or message of the card, provide a reminder of the event for which the card was sent, significantly outlast a paper greeting card, and creatively reflects the unique/special/memorable experience of the occasion for which the card was sent, or the person from which the card was received.

Accordingly, one goal of the inventive system is to deliver to the recipient of a greeting card a memento that is related to the message thereon and which will stay with and around the receiving person long beyond the card by which it was delivered.

Another goal is to create a card that presents, and has affixed to it, an ornament such as a charm that represents the sentiment or communication of the card. The charm allows the sentiment to stay in existence far after the occasion for which the card has been sent has passed. The communication, because of the charm, survives the typical viewing life of a card. The viewing life or period of time that one keeps the card in view is minimal. An individual throws a card away, files them, puts them in shoe boxes, etc. The person who has sent the card has sent a short lived communication that can become forgotten once the card is put away or thrown away.

Thus, by attaching the charm or other ornamentation to the card (the charm has a direct correlation to the message conveyed on the card), a personal memento or commemoration is provided to the recipient to remind them of the occasion for which the card was sent, and creates a memory of the sender—thus, the message of the card stays with the recipient forever. Additionally, since the charm can be attached to an accessory, it is worn by the recipient as jewelry or can adorn everything from a pin to a key chain, and thus it becomes a conversation piece or visual focal point to others.

Still another goal of this invention is an attachable/bridge mechanism. In every packaged card of the inventive system, there is provided literature on the bridge ring for the charm—stating the charm's purpose. The literature facilitates the message from the greeting card manufacturer, and further makes it clear that the charm is meant to be removed from the card, and attached to accessory item. Thus, the bridge ring is effectively a bridge mechanism, providing the recipient a vehicle on which to display the charm. Every card is packaged with a bridge ring, which makes it clear to the recipient that the charm is to be used in a separate capacity besides just adorning the card. It makes it clear to the consumer that the charm is to be detached from the card and attached to an accessory via a ring as a bridging mechanism, or can be used by itself on the recipients personal item to either observe or memorialize the occasion for which the card is sent.

A further goal of this invention is providing a storage/display mechanism for the ornament. The storage/display mechanism comprises an "accessory item"—such as a key chain, necklace, bracelet or other jewelry item—which will allow the recipient to store/display their charm on a functional personal article and allow it to become a lasting reminder for the message that the card acknowledged. The storage/display mechanism creates in the consumer a need or demand for "more" charms.

Yet another goal of this invention is to create a system for delivering ornaments such as charms. Through this invention, the greeting card manufacturer has a system for attaching a charm to a card, which now has direct correlation to the a message conveyed. The charm presents a personal memento to the recipient to remind them of the occasion for which the card was sent, and creates a memory of the sender—a detachable, physical manifestation of the meaning of the card. Therefore, the message of the card stays with the recipient forever through the inventive system of card+charm+charm ring+accessory, and further stimulates a future desire to receive, display, and accessorize with or collect charms.

Still other objects and advantages of the invention will become obvious in view of the following detailed disclosure.

BRIEF DESCRIPTION OF THE DRAWINGS

Further understanding of our invention will become apparent upon consideration of the following detailed description in conjunction with the drawings, in which:

FIG. 2 is a cross-sectional view taken along line 2—2 of FIG.1;

FIG. 3 is a front elevational view illustrating the ornament/charm affixed to a necklace or other jewelry/accessory item;

FIG. 4 is a front elevational view of a sheet of instructions for attaching the ornament to the necklace; and FIG. 5 is a front elevational view of accessory packaging in which the necklace or some other jewelry or other accessory item is retained, including instructions for its use with the ornament.

DETAILED DESCRIPTION OF THE INVENTION

Figure 1:
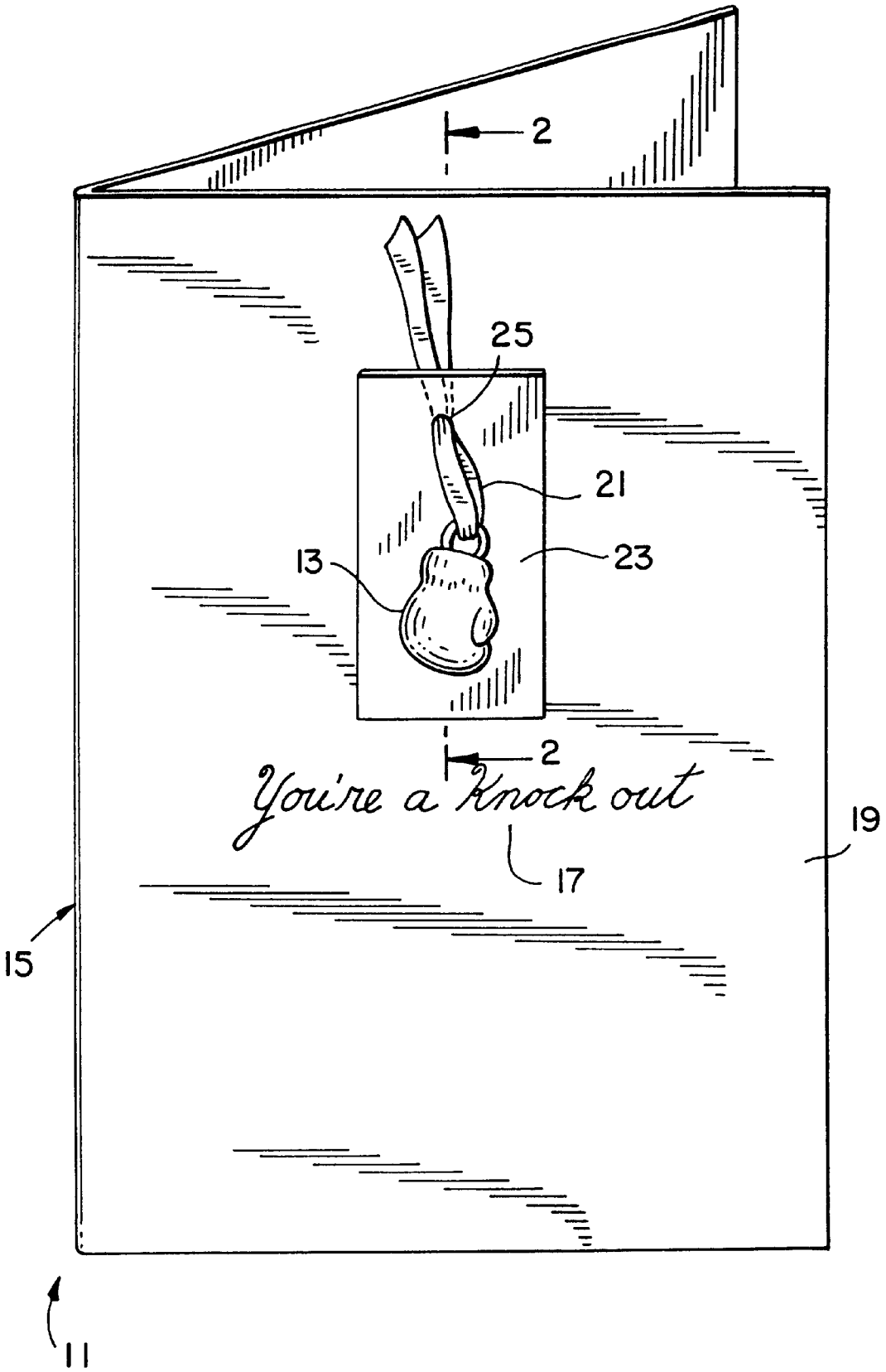
FIG. 1 is a perspective view of the greeting card of the invention in folded condition.

A greeting card or invitation system is provided and generally indicated at 11 (see FIG. 1). The system includes a three-dimensional hanging ornament 13, uniquely suited to attach to jewelry (bracelet, necklace, pin, cuff links, zipper pull), keychain, animal collar clip, or hair clip or pin. Ornament 13 is sold either as a component item or sold within a packaging of a greeting card/invitation 15, as described herein below. The system creates a gift item/gift greeting card, and promotes the collection of ornaments which in turn remind the recipient and/or commemorate a specific or special life occasion.

Greeting 15 card includes a printed greeting 17 on front panel 19 of card 15, which in most instances relates to or complements ornament 13, namely a pewter, brass, sterling silver, gold or base metal charm. Besides metal ornament/charm 13 may also be made of wood, stone or a man-made material. Ornament/charm 13 is secured onto front panel 19 of greeting card 15 via a ribbon 21 or any other attachment apparatus through a small secondary card "shield" 23 measuring anywhere from between 1"×1" to 2"×2" from which ornament/charm 13 can be selectively removed for keeping and attaching to an accessory that is either packaged with the greeting card or purchased separately. Accessories include bracelets, key chains, pins, cuff links, hair clips, hair pins, zipper pulls, dog collar clips, necklace 31 or other necklaces. FIG. 3 shows one example of such necklace 31, generally indicated at 31, to which a plurality of ornaments including ornament 13 is removably attached. The accessory becomes a vehicle for collecting and/or displaying ornaments/charms, thus both driving sales of greeting cards, and, optionally, leading consumers to a web site or retail location at which they can purchase multiple charms (to add to their accessory piece), greeting cards or accessory pieces.

Greeting card 15 may be packaged with a ring 33 (used as a bridging mechanism) for selectively attaching ornament/charm 13 to necklace 31 (see FIGS. 3 and 4). Ring 33 is retained along instruction sheet 35 that is typically packaged together with Card 15. Sheet 35 includes instructions which advise a prospective purchaser to attach ornament/charm 13 to an accessory such as necklace 31 by means of ring 33. In addition, the accessory such as necklace 31 is normally packaged for sale in a clear plastic packaging 37 along with an instruction sheet 39 which also advises the prospective purchaser to attach ornament/charm 13 to necklace 31 by means of ring 33. Thus, the inventive system encourages the mating of the message conveyed by the ornament/charm with a jewelry type accessory item. As a result, the message of the card lasts far longer with the card recipient than the card itself.

As stated, greeting card 15 includes a 4⅛"×5½" folded note card of paper material. The 4⅛"×5½" folded note card carries on front panel 19 a secondary card ("shield" 23) of paper material ranging from 2" square and lower. "Shield" 23 adheres to front panel 19 of the 4⅛"×5½" folded note card. At the top center of adhesive "shield" 23, ribbon 21 of man made material is affixed through a small hole 25. Ribbon 21 is looped and holds ornament/charm 13 made of pewter, brass, sterling silver or gold. Ornament 13 is removable from front panel 19 of greeting card 15 and is easily attached to the accompanying jewelry accessory (see FIG. 3).

The inventive system can also include a specially designed website for creating a card by choosing an ornament/charm and submitting a greeting in their own words. As a result, a "custom card" can be produced and sent to a designated recipient who will use the charm from the card to attach to an accompanying piece. Thus, the charm becomes a vehicle for memory for a specific event or acknowledgment whereby personal significance is added. As there are many derivations of greetings for any one ornament/charm, this method of custom personalization allows the consumer to create a product not available from a greeting card store's stocked inventory.

The inventive system can also include an invitation line whereby an ornament/charm is attached to an invitation and the recipient uses the charm to enhance a party favor, such as jewelry or key chain, etc. The recipient can keep an ornament/charm from the event (memorializing the event) and use the accompanying piece as a vehicle to house more ornaments/charms through receipt of other greeting cards, invitation, or by purchasing additional charms on line or through catalogues.

As can be appreciated, the primary goal of this invention is for a consumer to be able to deliver a message within a greeting card that offers a lasting impression by way of being a permanent keepsake to the recipient of what the card acknowledged. This goal is achieved with a charm. The charm is a detachable, physical manifestation of the message of the card, and thus the message of the card stays with the recipient forever.

The card and the charm of the invention convey the same message—the charm outlines the card and becomes a memory for the occasion for which the card was sent. When the recipient opens the card, they realize that the charm affixed to the card is a direct connotation of the greeting, and is detachable. The latter is made apparent to the recipient by the information noted on the inserted charm ring card that bears a double jump ring for affixing the charm onto a wearable, personal accessory—thus making the charm a visible and usable item in their life. The inserted card effectively guides the recipient to place the charm on such an accessory.

It is acknowledged that charm bracelets exist in the market for people who buy charm bracelets and charms that they collect for personal meanings and occasions for themselves. This invention, however, introduces a charm to a recipient via a different mechanism, a greeting card paired with an accessory. The reality of this invention is that the concept is meant to create a desire by the card recipient for more charms to be sent to them as personal messages or to memorialize/acknowledge special occasions. Conversely, the system urges the recipients family and friends to add to the recipient's collection by sending more cards with the attached charm—the primary goal being to personally add to their collection of memories, and the second to fill the accessory item for the recipient. Finally, the system, through this process, becomes viral as consumers (senders) in turn become recipients for cards with charms from the same friends and family that they had originally sent a card. The system thus creates an ongoing (lifetime) process where consumers and recipients (which at some point each person becomes both) commemorate, memorialize, acknowledge and communicate special messages or special occasions using cards with charm, essentially creating what could best be termed a tradition that creates a personal, meaningful, visible and lasting memory.

It will thus be seen that the objects set forth above, among those made apparent from the preceding description, are efficiently attained and, since certain changes may be made in the construction of the invention without departing from the spirit and scope of the invention, it is intended that all matter contained in the above description or shown in the accompanying drawings shall be interpreted as illustrative and not in a limiting sense.

It is also to be understood that the following claims are intended to over all the generic and specific features of the invention herein described and all statements of the scope of the invention which, as a matter of language, might be said to fall therebetween.

What is claimed is:

1. A set of greeting cards for delivering a sentiment on a greeting comprising:

a plurality of greeting cards each having a unique and different message written thereon with each message relating to a different specific event or occasion;

a plurality of ornaments, each of said ornaments being removably packaged with one of said cards;

wherein each ornament packaged with a greeting card has a unique configuration or shape selected to relate the ornament to the unique message written on the greeting card with which said ornament is packaged.

2. The set of claim 1 wherein each said card has a front panel on which said message is printed.

3. The set of claim 2, wherein each said ornament is removably affixed to said front panel of said greeting card with which said ornament is packaged at a location adjacent to where said message is printed.

4. The set of claim 3, wherein affixation of each ornament to said front panel of said card with which said ornament is packaged is reinforced by means of a card shield.

5. The set of claim 4, wherein said card shield is sized smaller than said panel and adhered thereto.

6. The set of claim 4, wherein each said ornament comprises a charm.

7. The set of claim 6, wherein said charm is made of one of a man-made material, metal material, wood material and stone material.

8. The set of claim 7, wherein said metal material is one of pewter, brass, silver, gold and base metal.

9. The set of claim 2, wherein each said ornament is removably affixed to said front panel of said card with which said ornament is packaged by means of a ribbon member.

10. The set of claim 1, further including a plurality of accessories to which each said ornament is capable of selective attachment thereto.

11. The set of claim 10, wherein one of said accessories is removably packaged with each said greeting card.

12. The set of claim 11, wherein each said accessory is selected from the group consisting of jewelry, key chains, clips and pins.

13. The set of claim 12, wherein said jewelry is selected from the group including bracelets, necklaces, pins, cufflinks and earrings.

14. The set of claim 10, further including a plurality of rings each for selectively attaching any of said ornaments to any of said accessories.

15. The set of claim 14, wherein one of said rings is removably packaged with each of said greeting cards.

16. The set of claim 14, further including instruction sheets recommending the attachment of any of said ornaments to one of said accessories by means of one of said rings.

17. The set of claim 16, wherein one of said instruction sheets is removably packaged with each of said greeting cards.

18. The set of claim 16, wherein one of said instruction sheets is removably packaged with each said rings.

19. The set of claim 16, wherein one of said instruction sheets is removably packaged with each of said accessories.

20. The set of claim 1, further including a plurality of rings each of which for selectively attaching any of said ornaments to a jewelry item.

21. The set of claim 20, wherein one of said rings is removably packaged with each said greeting card.

22. The set of claim 21, further including a plurality of instruction sheets each of which recommends attaching any of said ornaments to said jewelry item by means of one of said rings.

23. The set of claim 22, which one of said instruction sheets is removably packaged with each said card.

24. The set of claim 1, wherein said message written on each of said plurality of greeting cards is selected from the group consisting of a birthday message, a get well message, a goodbye message, a congratulations message, a retirement message, a friendship message, a holiday greeting message and a good luck message.

25. The set of claim 1, further including a plurality of instruction sheets each of which recommends attaching any of said ornaments to an accessory item.

26. The set of claim 25, wherein each said ornament has a configuration or appearance which visually reminds of said specific event or occasion.

27. A set of greeting cards for delivering a sentiment or greeting comprising:

a plurality of greeting cards each having unique and different message written thereon;

a plurality of unique and different ornaments at least one of which is removably packaged with each of said cards;

a plurality of rings at least one of which is removably packaged with each of said cards, and ornament each said capable of selectively attaching any of said ornaments to an accessory;

wherein each said ornament has a configuration, or shape selected to relate the ornament to the unique and different message printed on the card with which the ornament is packaged.

28. The set of claim 27, further including a plurality of accessories to which each said ornament is capable of selective attachment thereto by means of any of said rings.

29. The set of claim 28, wherein at least one said accessory is removably packaged with each said greeting card.

30. The set of claim 27, further including instruction sheets each recommending the attachment of any of said ornaments to an accessory.

31. The set of claim 27, wherein one of said instruction sheets is removably packaged with each said greeting card.

* * * * *